US012082708B2

(12) United States Patent
Godfrey et al.

(10) Patent No.: US 12,082,708 B2
(45) Date of Patent: Sep. 10, 2024

(54) FLEXIBLE SLING CHAIR WITH LIVING HINGE

(71) Applicant: Charleston Fab Lab, LLC, Charleston, SC (US)

(72) Inventors: Nicholas Godfrey, Charleston, SC (US); Cameron Murrell, Mount Pleasant, SC (US); Robert Royce Bertschy, Johns Island, SC (US)

( * ) Notice: Subject to any disclaimer, the term of this patent is extended or adjusted under 35 U.S.C. 154(b) by 0 days.

(21) Appl. No.: 17/644,862

(22) Filed: Dec. 17, 2021

(65) Prior Publication Data

US 2023/0190002 A1 Jun. 22, 2023

(51) Int. Cl.
*A47C 7/52* (2006.01)
*A47C 13/00* (2006.01)

(52) U.S. Cl.
CPC ..... *A47C 7/52* (2013.01); *A47C 13/00* (2013.01)

(58) Field of Classification Search
CPC ..... A47C 7/52
USPC ..... 297/440.13, 440.14, 451.11, 452.15
See application file for complete search history.

(56) References Cited

U.S. PATENT DOCUMENTS

| | | | | |
|---|---|---|---|---|
| 2,978,014 | A | 4/1961 | Mirrione | |
| 3,724,402 | A | 4/1973 | Thyberg et al. | |
| 4,193,632 | A | 3/1980 | Russell | |
| 5,169,258 | A | 12/1992 | Raynak | |
| 6,691,465 | B1 | 2/2004 | Stephan | |
| 6,811,226 | B1 * | 11/2004 | Kamrath | A47C 11/00 297/440.16 |
| 7,066,553 | B2 * | 6/2006 | Maloney | A47C 23/061 297/440.22 |
| 7,320,503 | B2 | 1/2008 | Eysing | |
| 7,854,573 | B2 | 12/2010 | Knudson et al. | |
| 7,866,923 | B2 | 1/2011 | Knudson et al. | |
| 8,104,839 | B2 * | 1/2012 | Huang | A47C 4/03 297/440.1 |
| 8,251,454 | B2 | 8/2012 | Tsukiji et al. | |
| 8,377,566 | B2 | 2/2013 | Durney et al. | |
| 8,663,531 | B2 | 3/2014 | De Taeye et al. | |
| 8,960,699 | B2 * | 2/2015 | Sprigle | A61G 5/1091 297/452.56 |

(Continued)

FOREIGN PATENT DOCUMENTS

| | | |
|---|---|---|
| WO | 2016034170 | 3/2016 |
| WO | 2019136083 | 11/2019 |
| WO | 2021195476 | 9/2021 |

*Primary Examiner* — David R Dunn
*Assistant Examiner* — Christopher E Veraa
(74) *Attorney, Agent, or Firm* — Thrive IP®; Jeremy M. Stipkala; William La Salle, III

(57) ABSTRACT

The present invention provides for construction of a variety of useful objects including chairs and ottomans from multiple polymers or high density polyethylene (HDPE) by utilizing a living hinge; the hinge comprising a single contiguous sheet of stock, the stock having some material removed rendering the sheet flexible and pliable; wherein some material removed forms a mesh or matrix; wherein the mesh or matrix has been optimized to allow for pliability while eliminating points of excessive stress; wherein the single contiguous sheet is bent in a predetermined shape; the single contiguous sheet relaxing into that predetermined shape over time; and wherein the bent shape retains flexibility under load and while returning to its predetermined shape when no longer under load.

16 Claims, 9 Drawing Sheets

© 2021 The Charleston Fab Lab, LLC

(56) References Cited

U.S. PATENT DOCUMENTS

| | | | | |
|---|---|---|---|---|
| 9,131,776 | B2 * | 9/2015 | Coffield | A47C 7/282 |
| 9,192,237 | B2 | 11/2015 | Bachar | |
| 11,213,131 | B2 * | 1/2022 | Nardi | A47C 4/027 |
| 2002/0195855 | A1 | 12/2002 | Teppo et al. | |
| 2009/0121534 | A1 * | 5/2009 | Brauning | A47C 4/025<br>297/440.14 |
| 2010/0314923 | A1 * | 12/2010 | Smith | A47C 7/54<br>297/354.1 |
| 2012/0248843 | A1 | 8/2012 | Sinchok et al. | |
| 2019/0208913 | A1 | 7/2019 | Thuma et al. | |
| 2021/0361071 | A1 | 11/2021 | Yao et al. | |

* cited by examiner

© 2021 The Charleston Fab Lab, LLC

© 2021 The Charleston Fab Lab, LLC

© 2021 The Charleston Fab Lab, LLC

© 2021 The Charleston Fab Lab, LLC

© 2021 The Charleston Fab Lab, LLC

© 2021 The Charleston Fab Lab, LLC

© 2021 The Charleston Fab Lab, LLC

FLEXIBLE SLING CHAIR WITH LIVING HINGE

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF INVENTION

This invention relates to a living hinge comprising a single flat, slotted polymer stock sheet that exhibits a higher degree of flexibility and pliability as compared with standard polymer stock, in some cases formed into chairs such as Adirondack-style lawn chairs; and in some instances, the chairs are manufactured using a minimal quantity of parts, assembled utilizing a minimal quantity of tooling, and packaged and sold in a minimal volume of packaging.

BACKGROUND OF THE INVENTION

Lawn furniture is known, and the Adirondack style of lawn chair has become common. However, several problems arise in the manufacture, packaging, and shipment of parts and in assembly of furniture by the end user. Assembling the furniture may require an excessive number of small parts including fasteners or tools. Parts are often large and awkwardly shaped, making efficient packaging or end user assembly difficult. Additional problems may arise in that constructing furniture by fastening several individual parts together can introduce multiple points of eventual fatigue or failure.

These problems are not limited to lawn furniture, but may extend to many products constructed using machined, milled, or molded polymers where strength and resistance to deformation or brittle fatigue are a concern. A common compromise in material construction is the sacrifice of strength, hardness, and overall stability for malleability, flexibility, pliability, or flexibility. Additional fatigue or failure can be introduced in instances where a pliable material is bent, rolled, or otherwise forced to maintain a single shape over a long period of time, preventing the material from resuming its original shape when stress or strain is relived. Other material issues exist where an object loses its flexibility over time as it fatigues and becomes too rigid after it is formed into a particular shape.

SUMMARY OF THE INVENTION

Unexpectedly, and building upon years of experience with computer numerical control ("CNC") milling, Applicant has invented an Adirondack-style flexible plastic sling chair and ottoman constructed using a living hinge. In some cases, the sling portion of the Applicant's chair, including the seatback and seating surface are manufactured from a single sheet of polymer which is bent or rolled into a curve which exhibits high flexibility and pliability. In some instances, some material is removed from the single sheet of polymer to form a mesh or matrix which imparts superior flexibility and resistance to deformation or fracture. In other cases, the Applicant's chair or ottoman is packaged and delivered with minimal packaging by utilizing minimal parts and tooling.

In still other cases, the Applicant's chair or ottoman is constructed using a minimal amount of material and generating little waste material. In further cases, the seatback of the Applicant's chair or the footrest area of the ottoman exhibits improved flexibility and resistance to deformation or damage.

Accordingly, some embodiments of the present invention relate to a chair, comprising:

- a frame, comprising a left vertical contoured member and a right vertical contoured member connected by one or more cross bars, the frame having a contour;
- the frame supporting a seating surface and a seatback, wherein the seating surface and seatback form a single contiguous sheet;
- the single contiguous sheet having been bent or rolled to align with the contour of the frame.

Further embodiments of the present invention relate to an ottoman comprising:

- an ottoman frame, comprising a left ottoman member and a right ottoman member, the ottoman frame having an ottoman contour and supporting a footrest section comprising a single contiguous ottoman sheet;
- the single contiguous ottoman sheet having been bent or rolled to align with the ottoman contour of the ottoman frame.

Still further embodiments of the present invention relate to a living hinge comprising:

- a single contiguous sheet of stock, the stock having some material removed rendering the sheet flexible and pliable;
- wherein some material removed forms a mesh or matrix;
- wherein the mesh or matrix has been optimized to allow for further flexibility and pliability while eliminating points of excessive stress;
- wherein the single contiguous sheet of stock is bent in a predetermined shape;
- the single contiguous sheet relaxing into the predetermined shape over time;
- and wherein the bent shape retains flexibility while returning to its predetermined shape no longer under load.

Additional embodiments relate to methods of manufacturing a chair, comprising:

- constructing a frame, comprising a left vertical contoured member and a right vertical contoured member connected by one or more cross bars, the frame having a contour; and
- interference-fitting a single contiguous sheet into the frame, wherein the single contiguous sheet comprises a seating surface and a seatback.

Still further embodiments relate to methods of manufacturing an ottoman, comprising:

- constructing an ottoman frame, comprising a left ottoman member and a right ottoman member connected by one or more cross bars, the ottoman frame having a contour and supporting a footrest; and
- interference-fitting a single contiguous ottoman sheet into the ottoman frame.

Further embodiments relate to methods of manufacturing a living hinge comprising:

- constructing a single contiguous sheet of stock, the stock having some material removed rendering the sheet flexible and pliable;
- removing some material to form a mesh or matrix;
- wherein the mesh or matrix has been optimized to allow for further flexibility and pliability while eliminating points of excessive stress;

wherein the single contiguous sheet of stock is bent in a predetermined shape;

the single contiguous sheet relaxing into the predetermined shape over time;

and wherein the bent shape retains flexibility while returning to its predetermined shape no longer under load.

While the disclosure provides certain specific embodiments, the invention is not limited to those embodiments. A person of ordinary skill will appreciate from the description herein that modifications can be made to the described embodiments and therefore that the specification is broader in scope than the described embodiments. All examples are therefore non-limiting.

DETAILED DESCRIPTION

Figure 1:
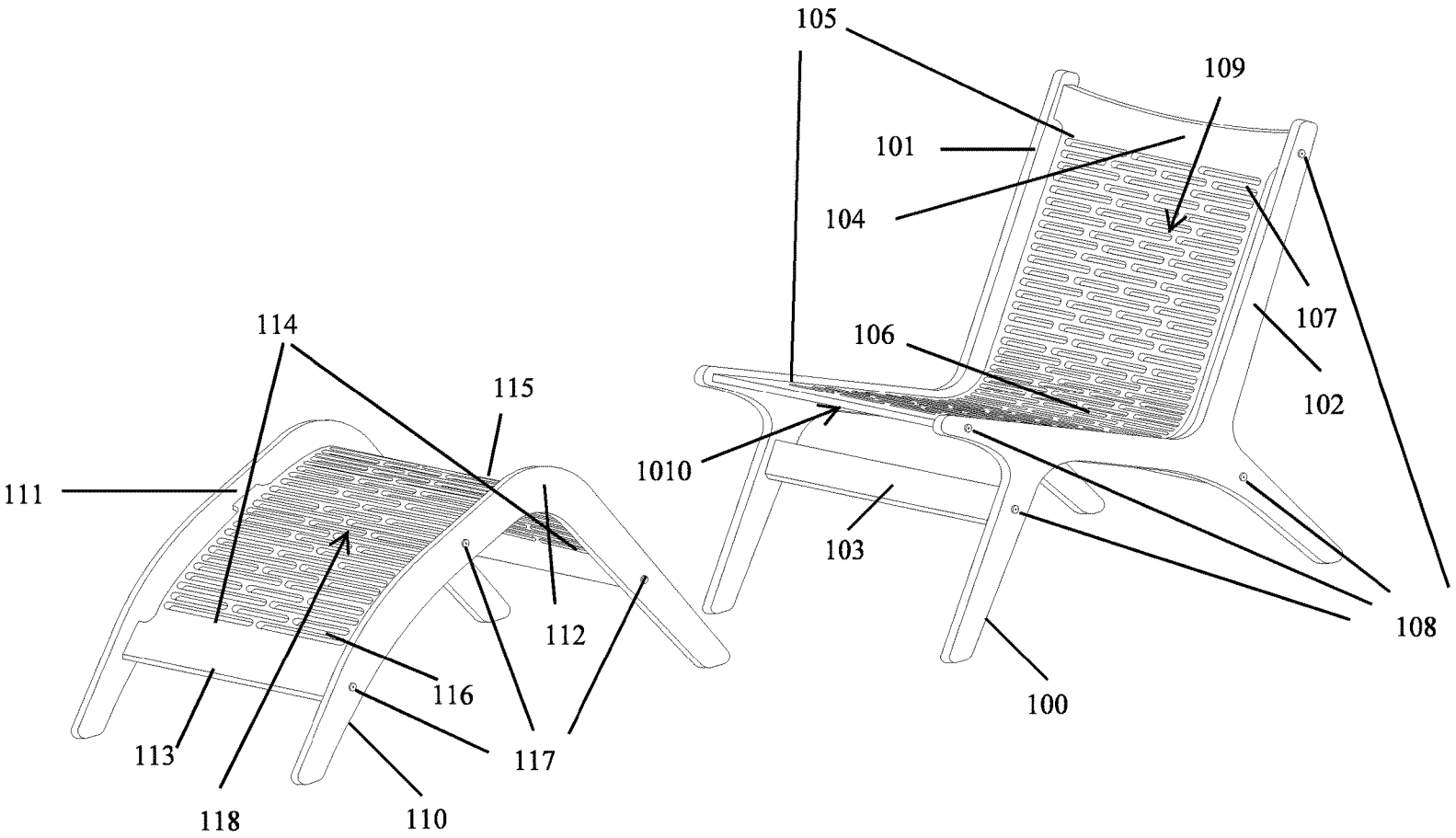
FIG. 1 depicts a perspective view of one embodiment of the invention comprising a sling chair and ottoman, each comprising a left vertical contoured frame member, a right vertical contoured frame member, and a single contiguous sheet with a living hinge.

As required, detailed embodiments of the present invention are disclosed herein; however, it is to be understood that the disclosed embodiments are merely exemplary of the invention that may be embodied in various forms. The figures are not necessarily to scale, and some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Unless defined otherwise, all technical and scientific terms used herein have the same meaning as is commonly understood by one of ordinary skill in the art to which this disclosure belongs. In the event that there is a plurality of definitions for a term herein, those in this disclosure prevail unless stated otherwise.

Wherever the phrase "for example," "such as," "including" and the like are used herein, the phrase "and without limitation" is understood to follow unless explicitly stated otherwise. Similarly, "an example," "exemplary" and the like are understood to be non-limiting.

The term "substantially" allows for deviations from the descriptor that don't negatively impact the intended purpose. Descriptive terms are understood to be modified by the term "substantially" even if the word "substantially" is not explicitly recited.

The term "about" when used in connection with a numerical value refers to the actual given value, and to the approximation to such given value that would reasonably be inferred by one of ordinary skill in the art, including approximations due to the experimental and or measurement conditions for such given value.

The terms "comprising" and "including" and "having" and "involving" (and similarly "comprises", "includes," "has," "involves," and "comprised of") and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, etc. Thus, for example, "a device having components a, b, and c" means that the device includes at least components a, b, and c. Similarly, the phrase: "a method involving steps a, b, and c" means that the method includes at least steps a, b, and c.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Any discussion of the prior art throughout the specification should in no way be considered as an admission that such prior art is widely known or forms part of common general knowledge in the field.

It is an object of the present invention to overcome or ameliorate at least one of the disadvantages of the prior art, or to provide a useful alternative.

As stated above, some embodiments of the present invention relate to a chair, wherein the seating section and seatback form a single contiguous chair sheet. As used herein, a "single contiguous sheet" indicates a single piece of stock material manufactured via CNC machining which originally takes a flat, substantially rectangular shape. The single contiguous chair sheet is subsequently bent or rolled about a vertex to align with the contour of the frame. A "vertex" is understood to be that point where all radii of a curve intersect. The contour of the chair frame takes the general shape of an Adirondack-style chair: the seatback portion is at a slight decline and the seated portion is at a slight incline; that is, the seatback portion as compared to the horizontal axis has an angle of greater than 90° and less than 180°, and the seat portion as compared to the horizontal axis has an angle greater than 0° and less than 90°.

As used herein, a frame can be any rigid structure formed from one or more pieces so as to support the chair. Minimally, the frame is constructed with a left vertical contoured member having at least two legs: a left foreleg and a left back leg. The left vertical contoured member is joined to a right vertical contoured member having at least two legs: a right foreleg and a right back leg. Optionally, any one leg can join with any other leg to form a leg structure. The left vertical contoured member and the right vertical contoured member together support a single contiguous sheet. The left and right vertical contoured members may also be connected with additional supporting structure for increased strength.

In some embodiments, the seated portion of the chair frame is adapted to support a person in a seated position. A seated position is understood to be that where the single contiguous chair sheet is curved such that, when sat upon, a person's upper body including torso is essentially vertical, while minimally a person's hips, buttocks, and legs above the knee are in an essentially horizontal position. Additionally, or alternatively, the seatback portion of the chair frame may be adapted to support a person in a reclined position. A reclined position is understood to be that where a person's upper body including torso is in an essentially horizontal position. To achieve a reclined position, the seatback portion of the chair frame can be at a position of between 135° to 180° as compared to the horizontal, in some cases. In either the seated or reclined position, the seated portion may further contain additional curvature so as to guide the user's legs into a desired ergonomic position.

In some embodiments, the frame or single contiguous sheet comprises minimally one or more polymers. In other embodiments, the frame or single contiguous sheet is made of high-density polyethylene (HDPE). In still other embodiments, the frame or single contiguous sheet comprises combinations of polymers and HDPE. The materials comprising the components of the chair, including the frame and single contiguous sheet, are pliable and flexible under strain while also being resistant to deformation or breakage.

In order to achieve increased flexibility and pliability, in some embodiments, some material may be removed from the single contiguous sheet, forming a mesh or matrix. This material may be removed by any suitable method, including but not limited to machining, cutting, punching, or casting. In some further embodiments, the single contiguous sheet may be bent or curved about this mesh or matrix. In some embodiments, the mesh or matrix design has been optimized to allow for maximum flexibility without causing excessive stress on any one point in the single contiguous sheet, thereby reducing the risk of stress fractures. Some embodiments of the chair frame or ottoman frame are constructed to restrain a single contiguous sheet in the form of a living hinge. Therefore, in some embodiments of the current invention, a chair or ottoman is constructed utilizing a living hinge.

In some embodiments, the chair or ottoman may be assembled via an interference fit between the various parts. An interference fit is understood to be a form of fastening between one or more tightly-fitted mating parts which produce a joint which is held together by friction after the mating parts are pushed together. The interference fit may be achieved through a variety of methods, including but not limited to press fit, friction fit, or snap-fit. For example, a press fit may be achieved wherein the introduction of one mating piece into another will cause minimal deformation; the deformation which introduces the friction necessary to maintain the joining of the parts. Alternatively, a friction fit may be achieved wherein there is minimal tolerance between two mating parts, such that friction between them is sufficient to maintain the integrity of the joint without causing deformation of any surface of the mating pieces. Still further, a snap-fit is achieved by attaching flexible parts which form the final joint by pushing the two parts' interlocking components together.

Flexibility in the frame or single contiguous sheet of the chair, or in the single contiguous ottoman sheet may be achieved through a variety of means. In some embodiments, the flexibility is inherent in, and limited by, the choice of materials used in construction. Flexibility is understood to be that allowance for movement under temporary or sustained minimal force to a maximum distance, wherein the object if flexed through the application of that force is resistant to plastic deformation and does not suffer brittle fracture, and wherein the object will reassume its original position when the stress is removed. In some embodiments, the flexibility is affected by the choice of materials or the overall shape of the frame. In other embodiments, flexibility is increased through the use of a structural design. A "structural design" is understood to be a mesh or other matrix design, or a combination thereof. In still others, a combination of choice of shape and the use of a mesh or other matrix design is used to achieve the desired amount of flexibility in the seatback.

A mesh is understood to be an interlacing of attached or interwoven strands. A matrix is understood to be an array of a number of repeating shapes. In some embodiments, the single contiguous sheet may contain the mesh, matrix, or combination design throughout its substantial entirety. In others, the mesh, matrix, or combination design may be limited to that portion of the single contiguous sheet which will ultimately comprise the seatback portion of the seat. In still other embodiments, the mesh or matrix chosen is merely decorative.

Resistance to plastic deformation (also known as "plasticity") may be achieved independently of flexibility. Plastic deformation of an object is understood to be a change in shape following application of some force, wherein the object will not return to its original shape. In some embodiments, resistance to plastic deformation is affected by the choice of materials or the overall shape of the frame. In other embodiments, resistance to plastic deformation is achieved through the use of a structural design. In still other instances, resistance to plastic deformation is achieved through a combination of material choice, shape, and use of structural design.

In some embodiments, the frame of the chair or the ottoman frame may be constructed through the use of two or more interlocking parts. Interlocking is understood to be that method through which two or more parts are united through employment of interlocking parts, such that one part fits within the confines of another. Interlocking includes but is not limited to hooking or dovetailing. Interlocking can also be achieved through the use of male-threaded and female-threaded unions.

The materials used to make the chairs and the ottomans of the present invention are not limited, and include any suitable materials. In some instances, one or more polymers can be used. High density polyethylene can be mentioned, for example. In other embodiments, individual interlocking frame parts and a single contiguous sheet may be fabricated such that chair or ottoman assembly requires little to no additional mating parts (such as screws, dowels, cams, glue, or rivets) or tools (such as screwdrivers, drills, bits, or hammers). In still other embodiments, individual frame parts and a single contiguous sheet may be fabricated such that, when packaged, the disassembled parts are fewer in quantity, take up less packaging volume, or have less weight as when compared to other disassembled chairs or ottomans currently on the market. In still further embodiments, the single contiguous sheet is bent or curved by the end user during assembly rather than prior to packaging, thus further allowing for less packaging footprint.

In some embodiments, the length of the seatback and seating surface of the chair are essentially equal. Where the seatback and seating surface are of equal length, the contour of the frame may or may not accommodate the user's legs and feet in an elevated position. In other embodiments, the length of the seating surface is extended beyond the length of the seatback to accommodate a footrest independent of any accompanying ottoman. A footrest is understood to be any shape contained within a frame shaped to accommodate the legs or feet and maintain the legs or feet in an elevated position.

As used herein, an "ottoman" is understood to be a footstool whether cushioned or not. In some embodiments, the highest portion of the ottoman that serves as a footstool will have a height equal to or less than the highest portion of the seating surface of the chair. In other embodiments, the ottoman can be higher than the highest portion of the seating surface. In some embodiments the ottoman will appear independent of an accompanying chair and may function as a footrest. In still further embodiments, the ottoman may alternatively function as a side table or a stool.

Certain instances provide chairs that are stackable. Further instances provide a chair stackable with a complimentary ottoman. In still further instances, a chair stacks first with an ottoman, and then with other chairs also stacked with ottomans. Stackability can be achieved in any suitable manner. In some instances, one or more chairs or ottomans are collectively stackable without substantially increasing the height or width of any individual chair or ottoman. Furthermore, some embodiments may further have two or more legs of the frame flared inward or outward (that is, at an angle with respect to vertical) in order to achieve the desired stackability.

Chairs and ottomans of the present invention can be manufactured by any suitable methods. Methods of manufacturing a chair comprising a contoured frame which is interference-fit with a single contiguous sheet also exist in some embodiments of the current invention. Such methods include constructing parts which, when assembled, comprise a frame, the frame comprising a left vertical contoured member and a right vertical contoured member connected by one or more cross bars, the frame having a contour; and interference-fitting a single contiguous sheet into the frame, wherein the single contiguous sheet comprises a seating surface and a seatback.

Methods of manufacturing an ottoman comprising a contoured frame which is interference-fit with a single contiguous sheet also exist in some embodiments of the current invention. Such methods include constructing parts which, when assembled, comprise an ottoman frame, the ottoman frame comprising a left ottoman contoured member and a right ottoman contoured member connected by one or more cross bars, the ottoman frame having an overall contour; and interference-fitting a single contiguous sheet into the ottoman frame.

DETAILED DESCRIPTION OF THE DRAWINGS

Further embodiments of the present invention can be described by reference to the accompanying drawings. Notably, the embodiments represented by the accompanying drawings are not drawn to scale and may be exaggerated in certain instances to emphasize specific features.

FIG. 1 shows, in one embodiment of the invention, a sling chair (100) and ottoman (110). The sling chair (100) further comprises a left vertical contoured chair frame (101), and right vertical contoured chair frame (102), a support attachment (103) and a single contiguous chair sheet (104). The single contiguous chair sheet (104) further comprises a chair mesh (105) and a chair living hinge (106). The chair mesh comprises a repeating series of horizontal cutouts (107). The single contiguous chair sheet (104) is affixed to the left vertical contoured chair frame (101) and right vertical contoured chair frame (102) with a series of fasteners (collectively 108 as shown on the right vertical contoured chair frame (102) and obscured from view on the left vertical contoured chair frame (101)). The assembled left vertical contoured chair frame (101), right vertical contoured chair frame (102), and single contiguous chair sheet (104) further comprise a seatback (109) and seating surface (1010) constructed about the chair living hinge (106). The ottoman (110) further comprises a left vertical contoured ottoman frame (111), and right vertical contoured ottoman frame (112), and a single contiguous ottoman sheet (113). The single contiguous ottoman sheet (113) further comprises an ottoman mesh (partially obstructed, 114) and an ottoman living hinge (partially obstructed, 115). The ottoman mesh (114) comprises a repeating series of horizontal cutouts (116). The single contiguous ottoman sheet (113) is affixed to the left vertical contoured ottoman frame (111) and right vertical contoured ottoman frame (112) with a series of fasteners (collectively 117 as shown on the right vertical contoured ottoman frame (112) and obscured from view on the left vertical contoured ottoman frame (111)). The assembled left vertical contoured ottoman frame (111), right vertical contoured chair frame (112), and single contiguous ottoman sheet (113) further comprise a footrest (118) constructed about the ottoman living hinge (115).

Figure 2:
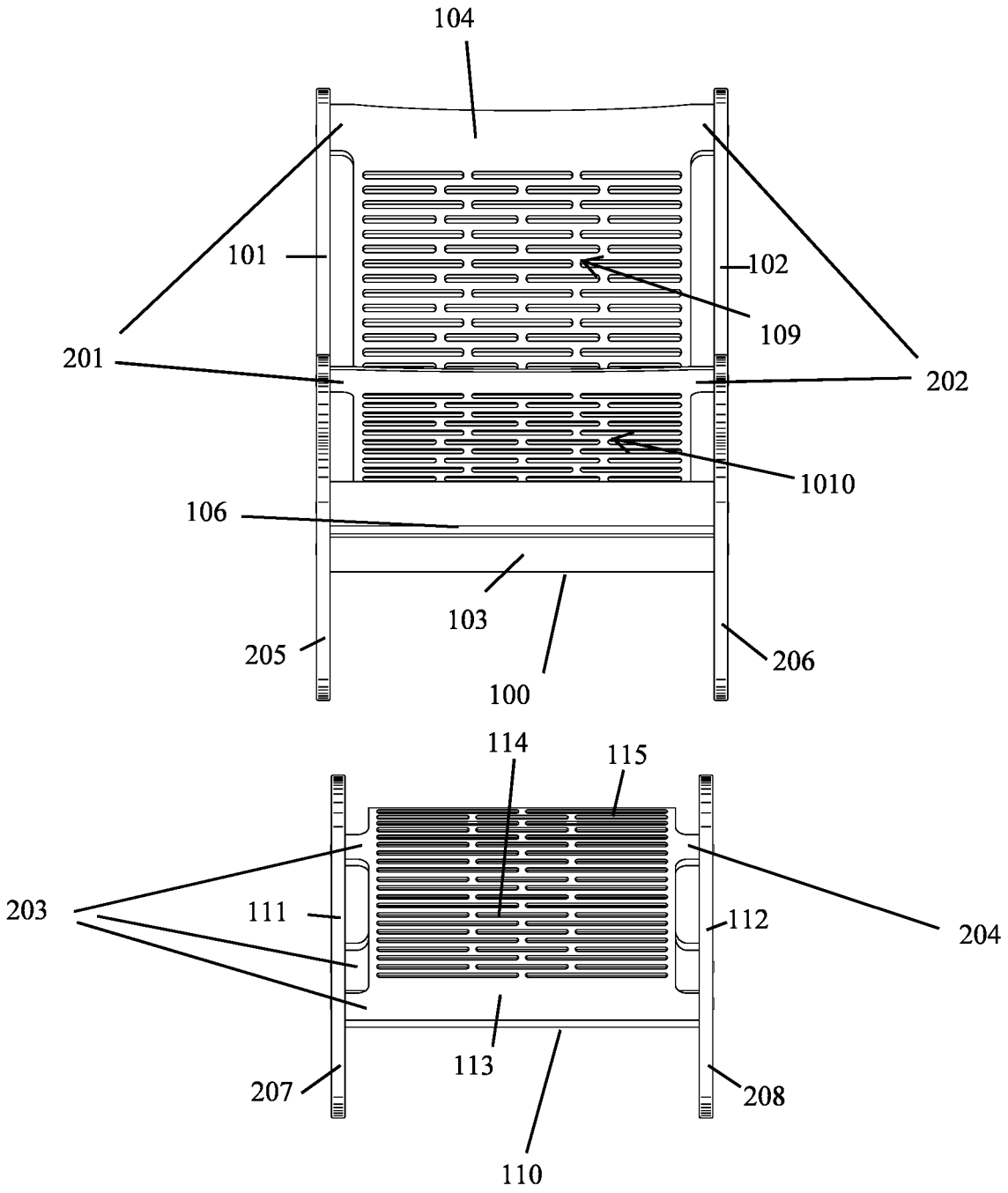
FIG. 2 depicts an orthogonal front view of the embodiment shown in FIG. 1.

FIG. 2 depicts an orthogonal front view of the embodiment shown in FIG. 1, wherein the height of the forwardmost portion of the seating surface (1010) of the chair (100) is exaggerated in apparent height with reference to the height of the seatback (109) to demonstrate the Adirondack style employed in this embodiment. The single contiguous chair sheet (partially obstructed, 104) comprises of a series of left tabs (collectively, 201) and right tabs (collectively, 202) which mate to corresponding fastening points (fasteners or interference fits not shown) on the left vertical chair frame (101) and right vertical chair frame (102), respectively. The height of the chair living hinge (partially obscured, 106) relative to the support attachment (103) is also exaggerated for visual clarity. The left vertical chair frame comprises a left rear leg (not shown) and left foreleg (205). The right vertical chair frame comprises a right rear leg (not shown) and right foreleg (206). The single contiguous ottoman sheet (113) comprises a series of left tabs (collectively, 203) and right tabs (collectively, 204) which mate to corresponding fastening points (fasteners or interference fits not shown) on the left vertical ottoman frame (111) and right vertical ottoman frame (112), respectively, and form the ottoman living hinge (115) about a portion of the ottoman mesh (114). The left vertical ottoman frame comprises a left ottoman rear leg (not shown) and left ottoman foreleg (207). The right vertical chair frame comprises a right ottoman rear leg (not shown) and right ottoman foreleg (208).

Figure 3:
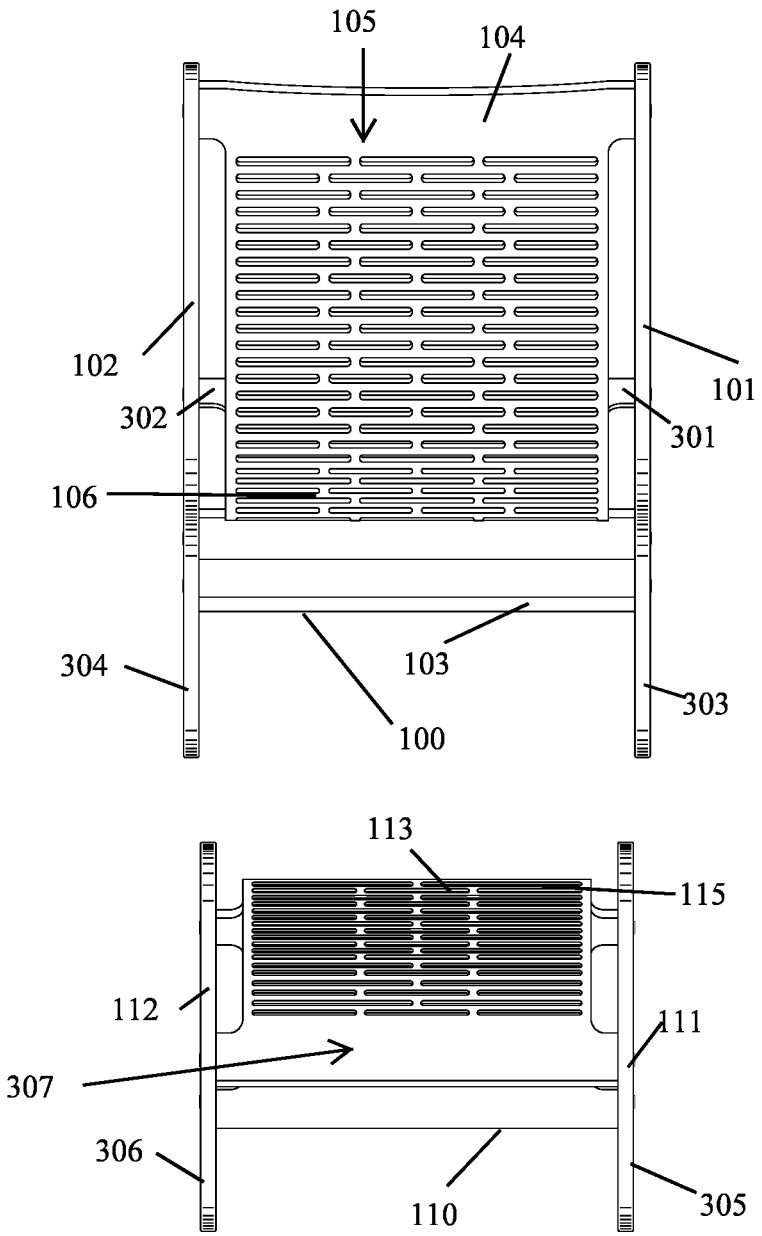
FIG. 3 depicts an orthogonal rear view of the embodiment shown in FIG. 1.

FIG. 3 depicts an orthogonal rear view of the embodiment shown in FIG. 1, wherein the seating surface of the chair (100) is not shown, but its height inferred by the position of left tabs (301) and right tabs (302) on the single contiguous chair sheet (104, partially obstructed), which are fastened or fitted to the left vertical chair frame (101) and right vertical chair frame (102), the seating surface (not shown) again exaggerated in apparent height with reference to the height of the seatback (105) to demonstrate the Adirondack style employed in this embodiment. The height of the chair living hinge (partially obscured, 106) relative to the support attachment (103) is also exaggerated for visual clarity. The left vertical chair frame comprises a left rear leg (303) and left foreleg (not shown). The right vertical chair frame comprises a right rear leg (304) and right foreleg (not shown). The rear portion (307) of the single contiguous ottoman sheet (partially obscured, 113), which in some embodiments facilitates or assists in facilitating stackability with other embodiments of chairs, ottomans, or both, is shown. The left vertical ottoman frame comprises a left ottoman rear leg (305) and left ottoman foreleg (not shown). The right vertical chair frame comprises a right ottoman rear leg (306) and right ottoman foreleg (not shown). The portion of the ottoman living hinge (115, partially obscured) which comprises the rear portion (307) of the single contiguous ottoman sheet (partially obscured, 113) is also shown.

Figure 4:
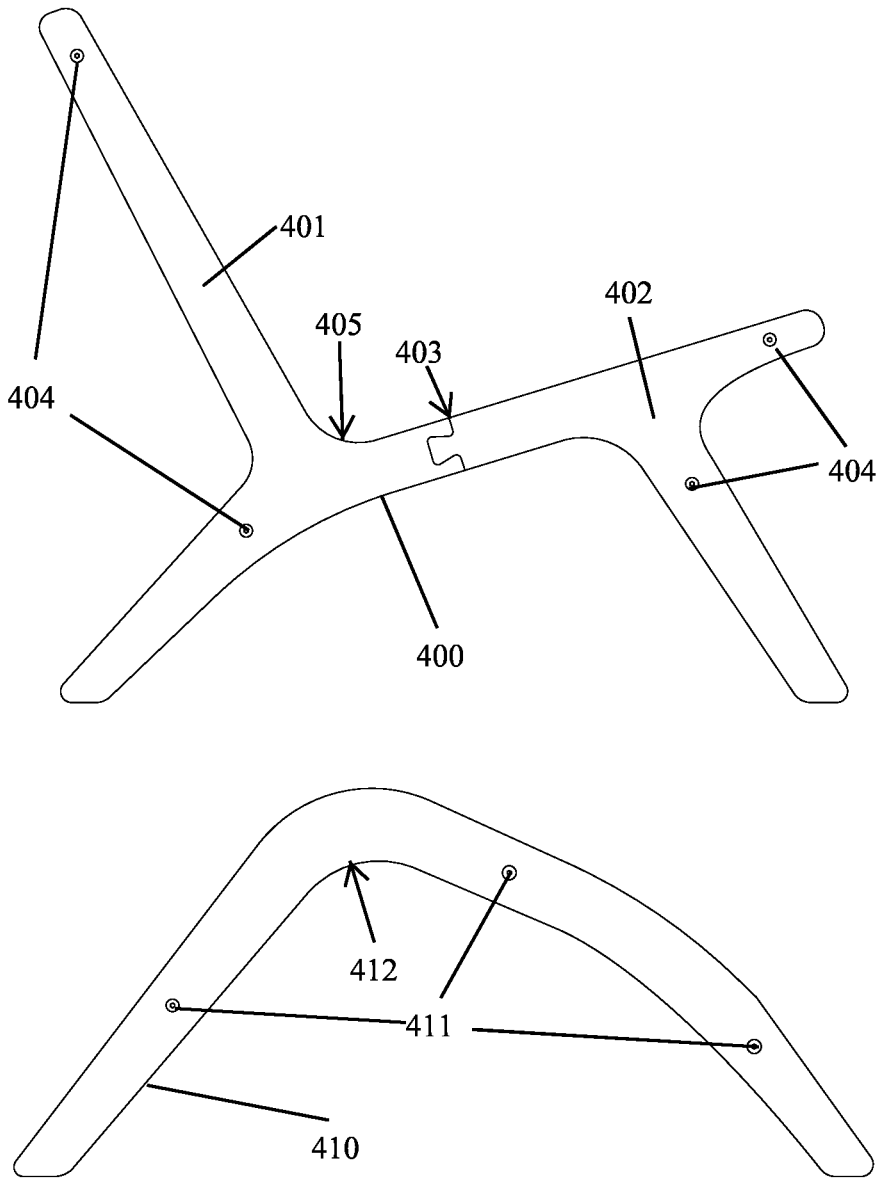
FIG. 4 depicts an orthogonal side view of one embodiment of the left vertical contoured chair frame and left vertical contoured ottoman frame (102) shown in FIG. 1.

FIG. 4 depicts an orthogonal side view of one embodiment of a vertical contoured chair frame (400) and vertical contoured ottoman frame (410). FIG. 4 shows, in one embodiment of the invention, that the vertical contoured chair frame (400) is further divided into a vertical contoured chair seatback part (401) and a vertical contoured chair seated surface part (402) which are fit together via interference fit (403). Embodiments of the ottoman frame (not shown) can be similarly constructed from multiple parts. Several examples of attachment locations wherein the vertical contoured chair frame (400) is attached to a single contiguous chair sheet (not shown) are also identified (collectively, 404). The chair frame living hinge contour (405) so manufactured to ensure the proper shape to be assumed by the chair living hinge (not shown) subsequent to assembly is also shown. Additionally, several examples of attachment locations wherein the vertical contoured ottoman frame (401) is attached to a single contiguous ottoman sheet (not shown) are also identified (collectively, 411). The ottoman frame living hinge contour (412) so manufactured to ensure the proper shape to be assumed by the ottoman living hinge (not shown) subsequent to assembly is also shown.

Figure 5:
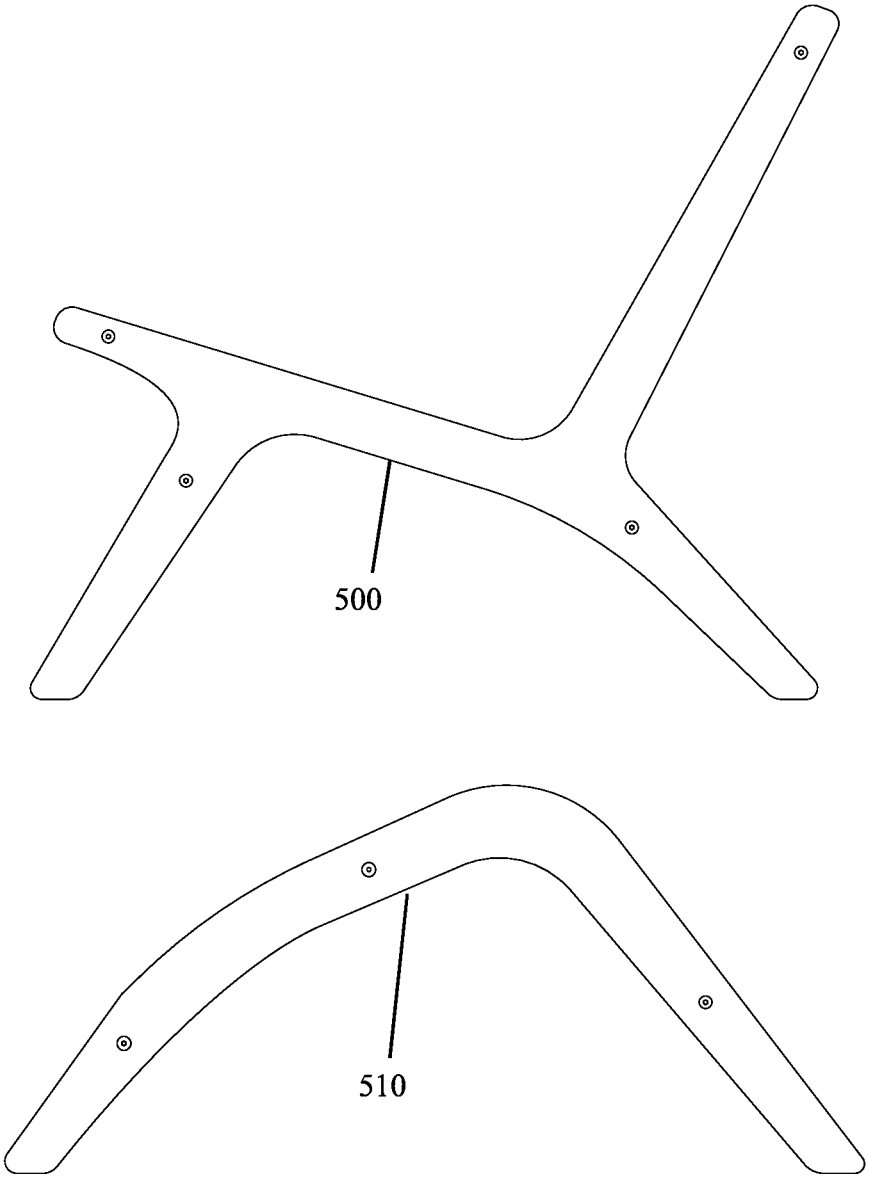
FIG. 5 depicts an orthogonal side view of one embodiment of the right vertical contoured chair frame and left vertical contoured ottoman frame shown in FIG. 1.

FIG. 5 depicts an orthogonal side view of one embodiment of a vertical contoured chair frame (500) (in some embodiments consisting of a single molded part) and vertical contoured ottoman frame (510) which, when paired with the embodiment of the contoured chair frame (400) and vertical contoured ottoman frame (410) of FIG. 4, when coupled with a single contiguous chair sheet (not shown) or single contiguous ottoman sheet (not shown), respectively, are assembled to construct an embodiment of the sling chair (100) or ottoman (101) as shown in FIG. 1.

Figure 6:
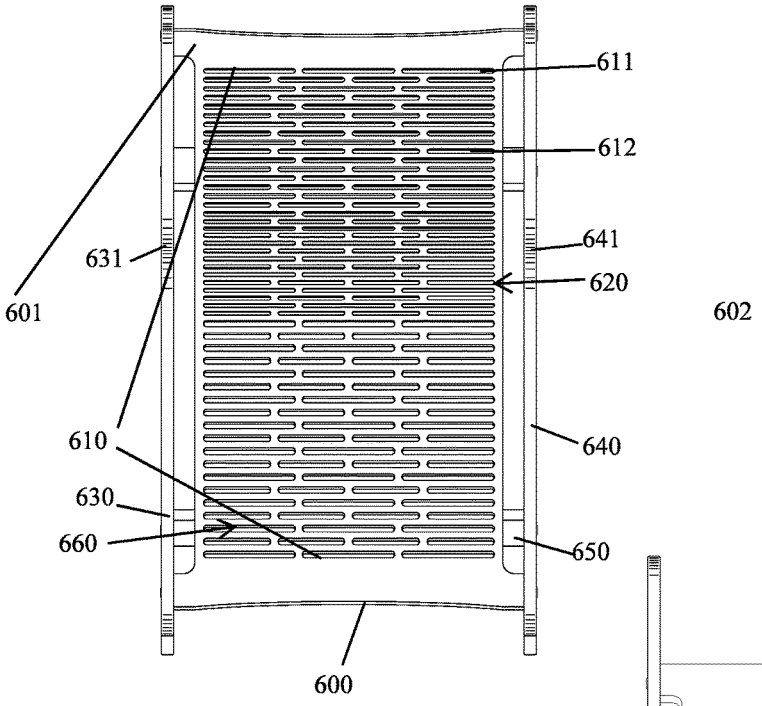
FIG. 6 depicts an orthogonal top-down view of the embodiment of a chair.

FIG. 6 depicts an orthogonal top-down view of one embodiment of a single contiguous chair sheet (600) with a mesh design (610) consisting of a row of three equally-sized elongated cutouts (611) followed by a row of four equally-sized cutouts (612), both rows having essentially equal height and aggregate width. A chair living hinge (620) is shown adjacent to a corresponding left contour (631) and right contour (641) on the left vertical chair frame (630) and right vertical chair frame (640). The single contiguous chair sheet (630) is connected with multiple left tabs (collectively 601) and multiple right tabs (collectively 602) to the left vertical chair frame (630) and right vertical chair frame (640), respectively. An optional support attachment (partially obscured, 650) is also shown below the seating surface (660) of the single contiguous chair sheet (600).

Figure 7:
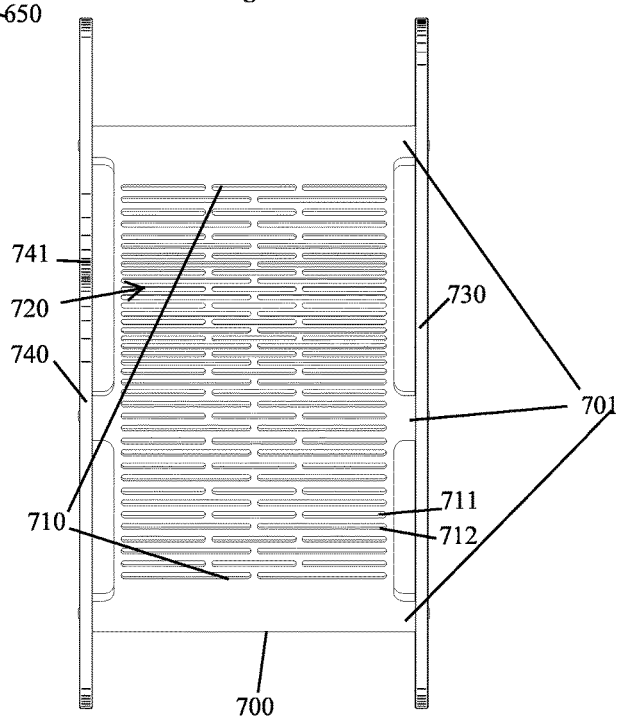
FIG. 7 depicts an orthogonal top-down view of an embodiment of an ottoman.

FIG. 7 depicts an orthogonal top-down view of one embodiment of a single contiguous ottoman sheet (700) with a mesh design (710) consisting of a row of three equally-sized elongated cutouts (711) followed by a row of two equally-sized cutouts (712), both rows having essentially equal height and aggregate width. An ottoman living hinge (720) is shown adjacent to a corresponding left contour (not shown) and right contour (741) on the left vertical ottoman frame (730) and right vertical ottoman frame (740). The single contiguous ottoman sheet (700) is connected with multiple left tabs (collectively 701) and multiple right tabs (collectively 702) to the left vertical ottoman frame (730) and right vertical ottoman frame (740), respectively. In some embodiments such as that shown, no support attachment is utilized, and the shape is maintained solely by attaching the single contiguous ottoman sheet (700) to the left vertical ottoman frame (730) and right vertical ottoman frame (740). Some embodiments of the chair (not shown) may also maintain shape without the use of support attachments. Notably, multiple mesh designs may be used to achieve the chair living hinge (not shown) or ottoman living hinge (720), and such mesh designs are not limited to the examples provided in the embodiments shown in FIGS. 6 and 7.

Figure 8:
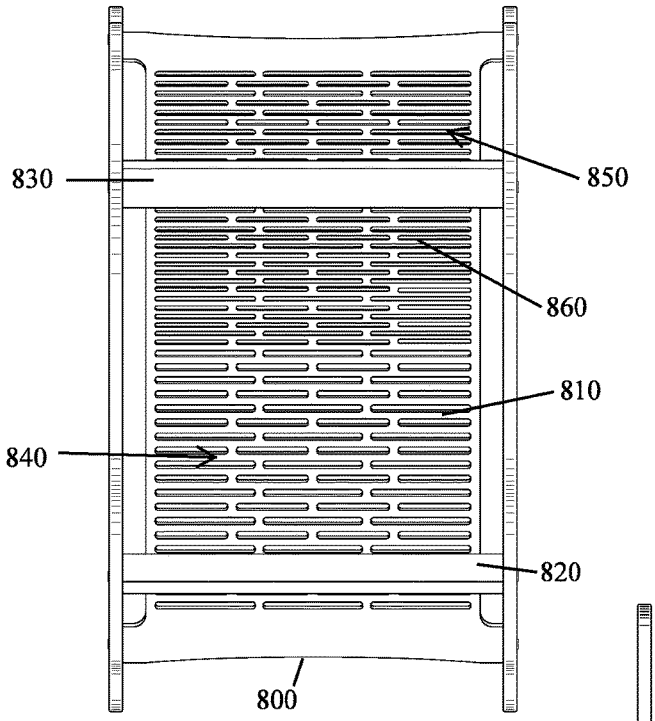
FIG. 8 depicts an orthogonal bottom-up view of an embodiment of a chair.

FIG. 8 depicts an orthogonal bottom-up view of one embodiment of a single contiguous chair sheet (800) with a mesh design (810). A forward support attachment (820) and rear support attachment (830) are also shown, with the forward support attachment (820) appearing directly beneath the seating surface (840) and the rear support attachment (830) appearing directly beneath the seatback (850). The chair living hinge (860) is also seen from underneath.

Figure 9:
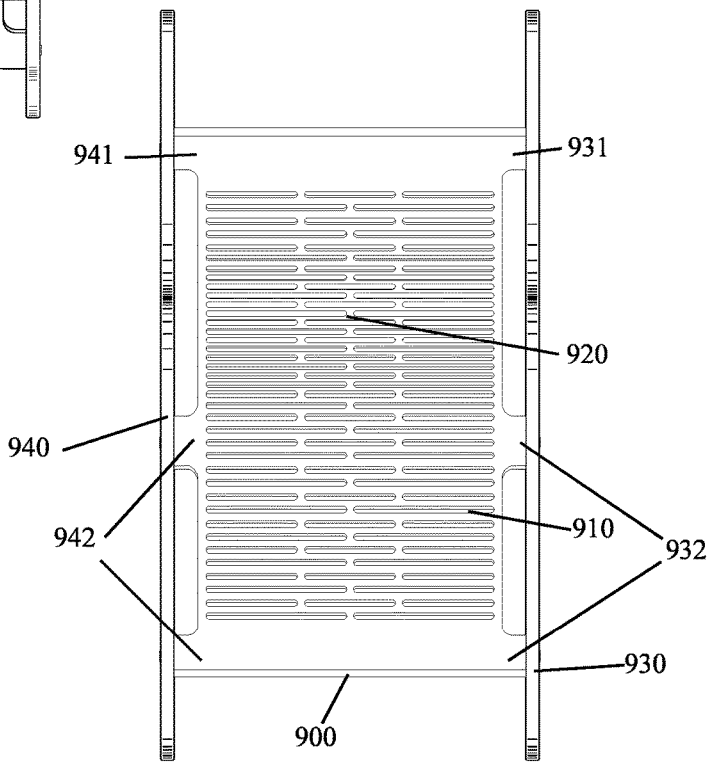
FIG. 9 depicts an orthogonal bottom-up view of an embodiment of an ottoman.

FIG. 9 depicts an orthogonal bottom-up view of one embodiment of a single contiguous ottoman sheet (900) with a mesh design (910). An ottoman living hinge (920) is shown, formed by curving the single contiguous ottoman sheet (900) and affixing the sheet at several points along the left vertical ottoman frame (930) and right vertical ottoman frame (940). In some embodiments, the single contiguous ottoman sheet (900) is affixed to the left vertical ottoman frame (930) and right vertical ottoman frame (940) with one rear left tab (931) and one rear right tab (941)—both rear tabs appearing to the rear of the ottoman living hinge (920)—and two forward left tabs (collectively, 932) and two forward right tabs (collectively, 942)—both forward tabs appearing to the front of the ottoman living hinge (920). In some embodiments such as that shown, no support attachment is utilized, and the shape is maintained solely by attaching the single contiguous ottoman sheet (900) to the left vertical ottoman frame (930) and right vertical ottoman frame (940). The number and location of attachment points for both the single contiguous chair sheet (not shown) and single contiguous ottoman sheet (900) may be varied based on the style and use of the assembled product. Therefore, these embodiments are not limiting but merely exemplary.

Figure 10:
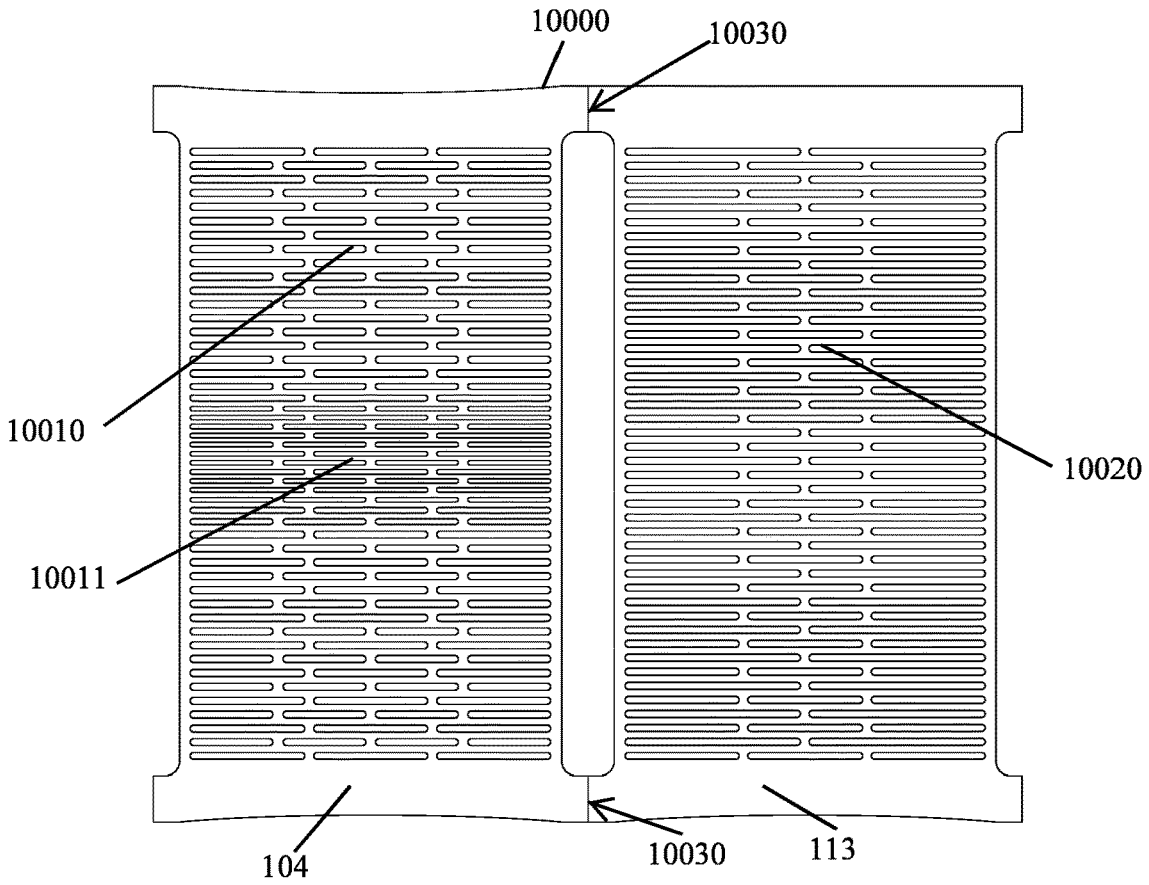
FIG. 10 depicts an orthogonal top-down of one embodiment of a single flat contiguous sheet comprised of a left mesh and a right mesh.
Figure 11:
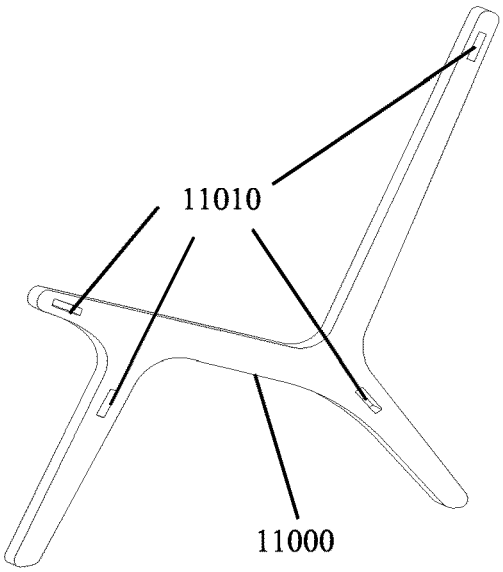
FIG. 11 depicts an orthogonal side view of one embodiment of a right vertical contoured chair frame with slots for interference fit.

FIG. 10 depicts an orthogonal top-down of one embodiment of an unassembled, single flat contiguous sheet (10000) comprised of a left chair mesh (10010) and a right ottoman mesh (10020). In some embodiments, the chair mesh (10010) is compressed about a portion (10011) of the whole in order to further accommodate the living hinge (not shown) when the chair mesh (10010) is curved into the required shape during assembly. In some embodiments, the ottoman mesh (10020) is similarly compressed (not shown)

about a portion (not shown) when the ottoman mesh (10020) is curved into the required ottoman living hinge (not shown) shape during assembly. In some instances, a single flat contiguous sheet (10000) is partitioned (collectively shown as 10030) in order to be snapped, cut, torn, or otherwise separated into two individual pieces which will constitute two single contiguous sheets which subsequently comprise a single contiguous chair sheet (104) and a single contiguous ottoman sheet (113) or any combination of two single contiguous chair sheets (104) or single contiguous ottoman sheets (113), FIG. 11 depicts an orthogonal side view of one embodiment of a vertical contoured chair frame (11000) with slots (collectively, 11010). In some embodiments, the slots (11010) accommodate tabs (not shown) on the single contiguous chair sheet (not shown). In some further embodiments, the tabs (not shown) on the single contiguous chair sheet (not shown) are cut to dimensions allowing for an interference fit. Some embodiments of a vertical contoured chair frame (not shown) also exist with slots (not shown) which accommodate a single contiguous ottoman sheet (not shown), and which may have dimensions allowing for an interference fit.

Figure 12:
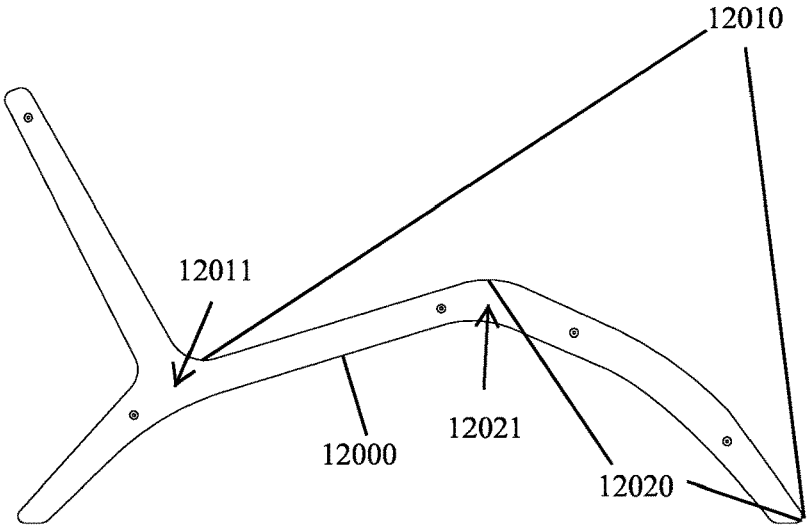
FIG. 12 depicts an orthogonal side view of one embodiment of a right vertical contoured chair frame with an extended seating surface comprising a footrest section.

FIG. 12 depicts an orthogonal side view of one embodiment of a vertical contoured chair frame (12000) with an extended seating surface (12010). Some further embodiments of the extended seating surface (12010) further comprise a footrest section (12020). Some embodiments of the vertical contoured chair frame (12000) may further incorporate contoured shape to accommodate a chair living hinge (12011) and a footrest living hinge (12021). The contour of the chair living hinge (12011) and footrest living hinge (12021) can assume any desired shape.

Figure 13:
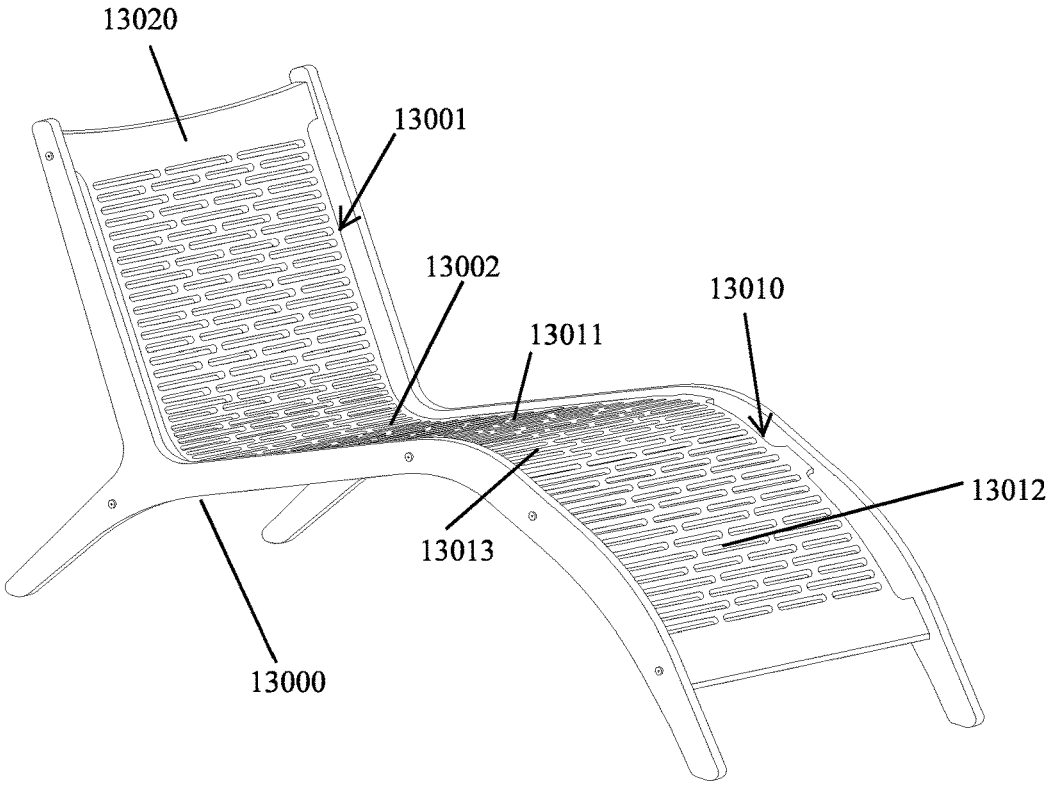
FIG. 13 depicts a perspective view of one embodiment of the invention comprising a sling chair with an extended seating section, comprising a single contiguous sheet with a seatback living hinge and a seating section living hinge.

FIG. 13 depicts a perspective view of one embodiment of the invention comprising a sling chair (13000) with an extended seating section (13010). The seatback (13001) and extended seating section (13010) comprise a single contiguous chair sheet (13020) wherein the seatback (13001) and extended seating section (13010) are formed around a seatback living hinge (13002). In some embodiments the seating section (13010) further incorporates a seat (13011) and a footrest (13012); wherein the seat (13011) and footrest (13012) are formed around a seating section living hinge (13013).

EMBODIMENTS

Embodiment 1

A chair, comprising:

a frame, comprising a left vertical contoured member and a right vertical contoured member connected by one or more cross bars, the frame having a contour;

the frame supporting a seating surface and a seatback, wherein the seating surface and seatback form a single contiguous sheet;

the single contiguous sheet having been bent or rolled to align with the contour of the frame.

Embodiment 2

The chair of embodiment 1, wherein the contour of the frame is adapted to accommodate a person in a seated position.

Embodiment 3

The chair of embodiment 1, wherein the contour of the frame is adapted to accommodate a person in a reclined position.

Embodiment 4

The chair of any one of embodiments 1-3, wherein the frame comprises one or more polymers.

Embodiment 5

The chair of any one of embodiments 1-4, wherein the frame comprises high-density polyethylene (HDPE).

Embodiment 6

The chair of any one of embodiments 1-5, wherein the single contiguous sheet comprises one or more polymers.

Embodiment 7

The chair of any one of embodiments 1-6, wherein the single contiguous sheet comprises high-density polyethylene (HDPE).

Embodiment 8

The chair of any one of embodiments 1-7, wherein the seating surface and seatback connect to the frame via an interference fit, chosen from press fit, friction fit, snap-fit, and combinations thereof.

Embodiment 9

The chair of any one of embodiments 1-8, wherein the single contiguous sheet comprises a structural design that imparts increased flexibility and resistance to deformation in the seatback.

Embodiment 10

The chair of any one of embodiments 1-9, wherein the frame comprises two or more interlocking pieces.

Embodiment 11

The frame of embodiment 10, wherein the interlocking pieces connect to each other via an interference fit chosen from press fit, friction fit, snap-fit, and combinations thereof.

Embodiment 12

The chair of any one of embodiments 1-11, wherein the seating surface of the frame is adapted to further support a footrest.

Embodiment 13

An ottoman comprising:

an ottoman frame, comprising a left ottoman member and a right ottoman member, the ottoman frame having an ottoman contour and supporting a footrest section comprising a single contiguous ottoman sheet;

the single contiguous ottoman sheet having been bent or rolled to align with the ottoman contour of the ottoman frame.

Embodiment 14

The ottoman of embodiment 13, wherein the single contiguous ottoman sheet comprises one or more polymers.

Embodiment 15

The ottoman of any one of embodiments 13-14, wherein the single contiguous ottoman sheet comprises high-density polyethylene (HDPE).

Embodiment 16

The ottoman of any one of embodiments 13-15, wherein the single contiguous ottoman sheet comprises a structural design that imparts increased flexibility and resistance to deformation.

Embodiment 17

A living hinge, comprising:

a single contiguous sheet of stock, the stock having some material removed rendering the sheet flexible and pliable;

wherein some material removed forms a mesh or matrix;

wherein the mesh or matrix has been optimized to allow for further flexibility and pliability while eliminating points of excessive stress;

wherein the single contiguous sheet of stock is bent in a predetermined shape; the single contiguous sheet relaxing into the predetermined shape over time;

and wherein the bent shape retains flexibility under temporary load while returning to its predetermined shape when no longer under that load.

Embodiment 18

A chair of any of Embodiments 1-12, wherein the seatback and seating surface are constructed utilizing the living hinge of embodiment 17.

Embodiment 19

An ottoman of any of Embodiments 13-16, wherein the footstool is constructed utilizing the living hinge of embodiment 17.

Embodiment 20

The chair of Embodiment 18, wherein a footrest is constructed at one end of the seating surface utilizing the living hinge of embodiment 17.

Embodiment 21

The chair of any of Embodiments 1-12, 18, or 20, wherein the chair is adapted to be stackable with other chairs Embodiment 22

The chair of any of Embodiments 1-12, 18, or 20, wherein the chair is adapted to be stackable with an ottoman.

Embodiment 23

The ottoman of any of Embodiments 13-16 or 19, wherein the ottoman is adapted to be stackable with a chair.

Embodiment 24

The ottoman of any of Embodiments 13-16 or 19, wherein the ottoman is adapted to be stackable with other ottomans.

Embodiment 25

The chair of any of Embodiments 1-12, 18, 20, or 21-22, and an ottoman of any of Embodiments 13-16, 19, or 23-24, wherein the chairs and ottomans are collectively stackable upon each other.

Embodiment 26

A method of manufacturing a chair, comprising:

constructing a frame, comprising a left vertical contoured member and a right vertical contoured member connected by one or more cross bars, the frame having a contour; and interference-fitting a single contiguous sheet into the frame, wherein the single contiguous sheet comprises a seating surface and a seatback.

Embodiment 27

A method of manufacturing an ottoman, comprising:

constructing an ottoman frame, comprising a left ottoman member and a right ottoman member connected by one or more cross bars, the ottoman frame having a contour and supporting a footrest; and interference-fitting a single contiguous ottoman sheet into the ottoman frame.

Embodiment 28

A method of manufacturing a living hinge, comprising:

constructing a single contiguous sheet of stock, the stock having some material removed rendering the sheet flexible and pliable;

removing some material to form a mesh or matrix;

wherein the mesh or matrix has been optimized to allow for further flexibility and pliability while eliminating points of excessive stress;

wherein the single contiguous sheet of stock is bent in a predetermined shape;

the single contiguous sheet relaxing into the predetermined shape over time;

and wherein the bent shape retains flexibility while returning to its predetermined shape no longer under load.

As previously stated, detailed embodiments of the present invention are disclosed herein; however, it is to be understood that the disclosed embodiments are merely exemplary of the invention that may be embodied in various forms. It will be appreciated that many modifications and other variations stand within the intended scope of this invention as claimed below. Furthermore, the foregoing description of various embodiments does not necessarily imply exclusion. For example, "some" embodiments may include all or part of "other" and "further" embodiments within the scope of this invention. In addition, "a" does not mean "one and only one;" "a" can mean "one and more than one."

We claim:

1. A chair, comprising:

a frame, comprising a left vertical contoured member and a right vertical contoured member connected by one or more cross bars, the frame having a contour;

the frame supporting a pliable and flexible sling portion manufactured from a single contiguous sheet, wherein the single contiguous sheet comprises a seating surface and a seatback;

the single contiguous sheet having had some material removed from a single sheet of stock to form a mesh design and having been bent or rolled about a vertex to align with the contour of the frame;

the mesh design comprising a first row of thee equally-sized elongated cutouts and a second row of four equally-sized cutouts, with the first row and the second row having an equal height and an equal aggregate width.

2. The chair of claim 1, wherein the contour of the frame is adapted to accommodate a person in a seated position.

3. The chair of claim 1, wherein the contour of the frame is adapted to accommodate a person in a reclined position.

4. The chair of claim 1, wherein the frame comprises one or more polymers.

5. The chair of claim 1, wherein the frame comprises high-density polyethylene (HDPE).

6. The chair of claim 1, wherein the single contiguous sheet comprises one or more polymers.

7. The chair of claim 1, wherein the single contiguous sheet comprises high-density polyethylene (HDPE).

8. The chair of claim 1, wherein the seating surface and the seatback connect to the frame via an interference fit, chosen from press fit, friction fit, snap-fit, and combinations thereof.

9. The chair of claim 1, wherein the frame comprises two or more interlocking pieces.

10. The chair of claim 9, wherein the two or more interlocking pieces connect to each other via an interference fit chosen from press fit, friction fit, snap-fit, and combinations thereof.

11. The chair of claim 1, wherein the seating surface is adapted to further support a footrest.

12. An ottoman comprising:

an ottoman frame, comprising a left ottoman member and a right ottoman member, the ottoman frame having an ottoman contour;

the ottoman frame supporting a pliable and flexible footrest section comprising a single contiguous ottoman sheet having had some material removed from a single sheet of ottoman stock to form an ottoman mesh design;

the single contiguous ottoman sheet having been bent or rolled about a vertex to align with the ottoman contour of the ottoman frame;

the ottoman mesh design comprising a first row of thee equally-sized elongated cutouts and a second row of two equally-sized cutouts, with the first row and the second row having an equal height and an equal aggregate width.

13. The ottoman of claim 12, wherein the single contiguous ottoman sheet comprises one or more polymers.

14. The ottoman of claim 12, wherein the single contiguous ottoman sheet comprises high-density polyethylene (HDPE).

15. A method of manufacturing a chair, comprising:

constructing a pliable and flexible frame, comprising a left vertical contoured member and a right vertical contoured member connected by one or more cross bars, the frame having a contour; and interference-fitting a pliable and flexible single contiguous sheet having had some material removed from a single sheet of stock to form a mesh design, and that is bent about a vertex into the frame, wherein the single contiguous sheet comprises a seating surface and a seatback;

wherein the mesh design comprises a first row of three equally-sized elongated cutouts and a second row of four equally-sized cutouts, with the first row and the second row having an equal height and an equal aggregate width.

16. A method of manufacturing an ottoman, comprising:

constructing a pliable and flexible ottoman frame, comprising a left ottoman member and a right ottoman member connected by one or more cross bars, the ottoman frame having an ottoman contour;

wherein the ottoman contour supports a pliable and flexible footrest section by interference-fitting a single contiguous ottoman sheet having some material removed from a single sheet of ottoman stock to form an ottoman mesh design and that is bent about a vertex into the ottoman frame;

the ottoman mesh design comprising a first row of thee equally-sized elongated cutouts and a second row of two equally-sized cutouts, with the first row and the second row having an equal height and an equal aggregate width.

* * * * *